US005359965A

United States Patent [19]

Tenerowicz

[11] Patent Number: 5,359,965

[45] Date of Patent: Nov. 1, 1994

[54] FURNACE WINDBOX/WATER WALL SEAL

[75] Inventor: Ronald J. Tenerowicz, Agawam, Mass.

[73] Assignee: Combustion Engineering, Inc., Windsor, Conn.

[21] Appl. No.: 172,622

[22] Filed: Dec. 22, 1993

[51] Int. Cl.[5] ..... F22B 37/00

[52] U.S. Cl. ..... 122/6.5; 110/182.5; 122/235.13; 122/235.18

[58] Field of Search ..... 122/6 A, 6 B, 6.5, 235.12, 122/235.13, 235.18; 110/182.5; 165/181, 182, 183

[56] References Cited

U.S. PATENT DOCUMENTS

| | | | |
|---|---|---|---|
| 1,896,486 | 2/1933 | Franklin | 122/235.18 |
| 4,685,703 | 8/1987 | Brock | 122/6.5 X |
| 5,119,743 | 6/1992 | Mailliet et al. | 110/182.5 |

*Primary Examiner*—Edward G. Favors
*Attorney, Agent, or Firm*—Robert S. Smith

[57] ABSTRACT

A furnace apparatus which includes a plurality of water walls each including a plurality of tubes, the water walls collectively enclose a combustion chamber. The apparatus includes a plurality of windboxes and each of the windboxes are disposed intermediate adjacent water walls. A seal assembly seals the interface between respective windboxes with the water walls adjacent thereto and each of seal assemblies comprising first and second generally planar plates disposed in face to face abutting relationship. The apparatus also includes first means for mounting the first plate to the water wall and second means for mounting the second plate to the windbox. The means for mounting the first plate and the means for mounting the second plate define a chamber therebetween, the apparatus also includes means for enclosing the chamber that includes a flexible member allowing relative movement between the first and second plates. Insulation is disposed within the chamber to obstruct the passage any gasses passing intermediate the first and second plates into the chamber.

10 Claims, 3 Drawing Sheets

FURNACE WINDBOX/WATER WALL SEAL

TECHNICAL FIELD

The invention has application to the field of steam generation apparatus and particularly relates to sealing the interface between the windbox and the water wall of such apparatus. The typical furnace as viewed in a plan view has a generally square arrangement of water wall each made up of a plurality of tubes. The tubes in the respective water walls are disposed in generally parallel relationship. Disposed at corners of the typical furnace are windboxes that direct combustion air into the furnace. There are extremes of temperature between the water wall of the furnace and the windboxes, where the relatively cool combustion air is being admitted into the furnace. It is of great importance to minimize any leakage of furnace gasses from the interior of the furnace through the interface between the water wall and the windbox.

A complicating factor in providing such seal is that the structures involved are very large. They often extend upwards as high as many multi-story buildings. Because of this size the apparatus often must be assembled at the site where the furnace apparatus is to be ultimately operated.

In the prior art various convoluted or accordion style elements have been utilized to prevent such leakage and also to accommodate the differential expansion which will occur because of the very substantial differences in temperatures during start up of the apparatus.

OBJECTS AND SUMMARY OF THE INVENTION

It is an object of the present invention to provide apparatus which will effectively seal the water wall and windbox interface despite the enormous temperature differentials between the respective structures It is another object of the invention to provide apparatus which will lend itself to easy assembly at the job site.

Still another object of the invention is to provide apparatus which is capable of withstanding a pressure of 40 inches of water gauge pressure and a temperature of 1,000 degrees F. on either or both sides of the seal.

It is still another object of the invention to provide apparatus which will withstand relative shear movement between the water wall and the windbox as a result of the thermal expansion of the elements.

Yet another object of the invention is to provide apparatus which will have a much longer service life than prior art seals for such installations.

It is now been found that these and other objects of the invention may be attained in a furnace apparatus which includes a plurality of water walls each including a plurality of tubes, the water walls collectively enclosing a combustion chamber. The apparatus includes a plurality of windboxes and each of the windboxes being disposed intermediate adjacent water walls. A seal assembly seals the interface between respective windboxes with the water walls adjacent thereto and each of seal assemblies comprises first and second generally planar plates disposed in face to face abutting relationship. The apparatus also includes first means for mounting the first plate to the water wall and second means for mounting the second plate to the windbox. The means for mounting the first plate and the means for mounting the second plate define a chamber therebetween, the apparatus also includes means for enclosing the chamber that includes a flexible member allowing relative movement between the first and second plates. Insulation is disposed within the chamber to obstruct the passage any fly ash passing intermediate the first and second plates into the chamber.

In some forms of the invention the second means for mounting comprises an L-shaped channel. The first means for mounting may include a generally planar first plate welded to respective tubes of the water wall. In some forms of the invention the means for enclosing includes an L-shaped member having a first flange at one axial extremity. The means for enclosing may further include an angle plate having a second flange at one axial extremity and the other axial extremity being welded to the first plate. The means for enclosing includes a fabric portion joining the first and second flanges and has insulation disposed therein in some forms of the invention.

BRIEF DESCRIPTION OF THE DRAWING

The invention will be better understood by reference to the accompanying drawing in which.

DESCRIPTION OF THE PREFERRED EMBODIMENT

Figure 1:
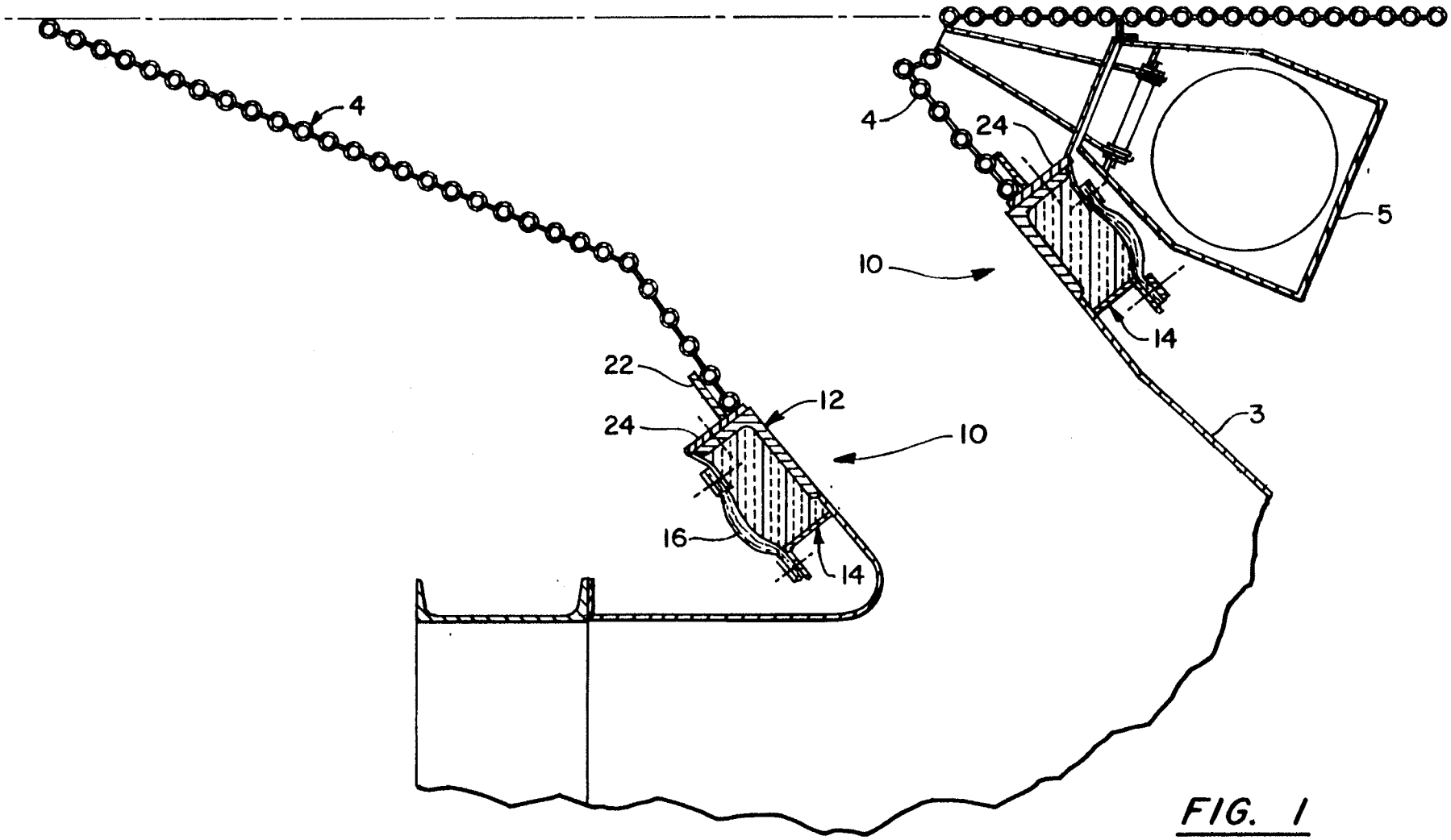
FIG. 1 is a fragmentary sectional view taken on a horizontal plane showing a portion of the water wall and a portion of the windbox together with the seal in accordance with one form of the present invention.
Figure 2:
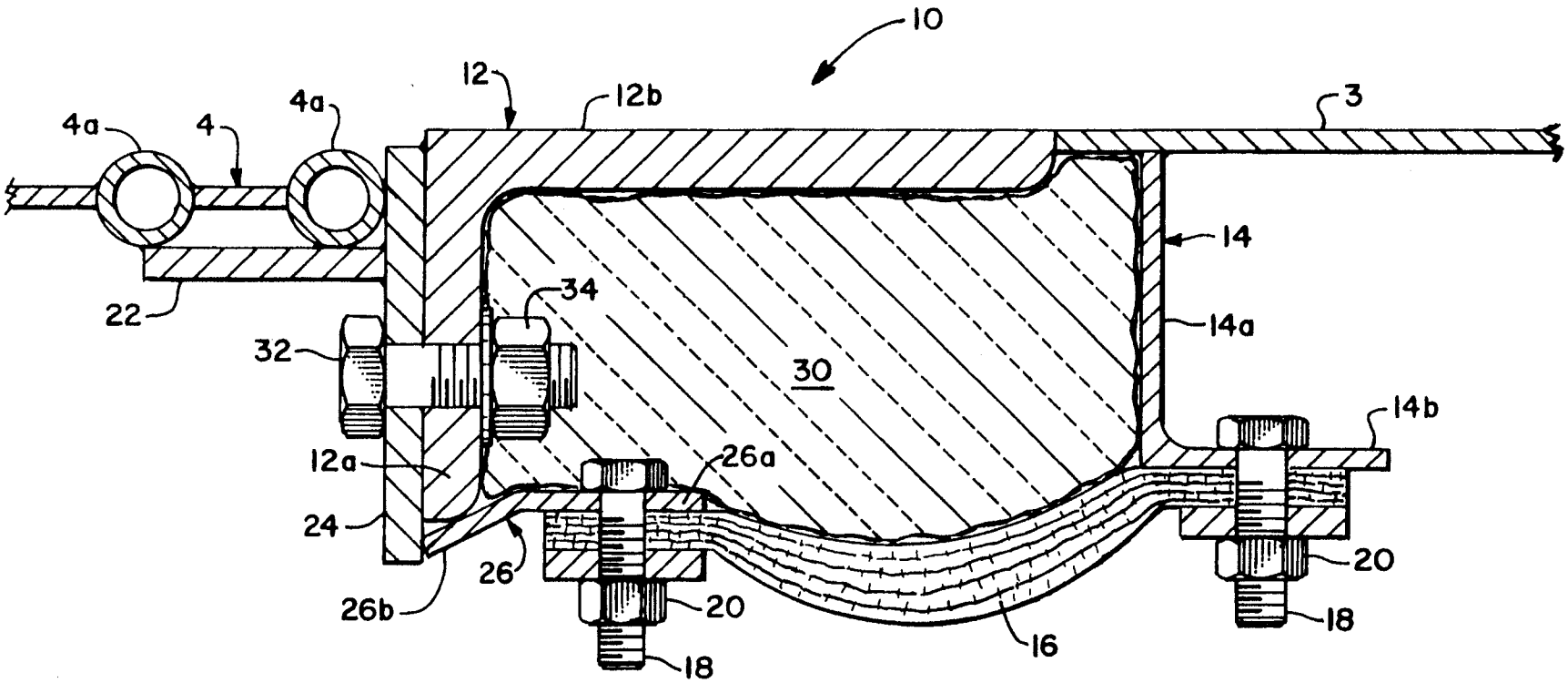
FIG. 2 is a sectional view similar to FIG. 1 and to an enlarged scale which illustrates the seal of FIG. 1 in greater detail.
Figure 3:
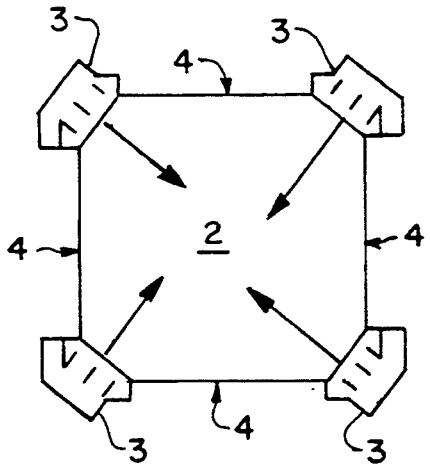
FIG. 3 is a partially schematic view illustrating in plan view a furnace apparatus and illustrating the relative locations of the water walls and windboxes.

Referring now to FIGS. 1–3 there is shown a furnace 2 having water walls 4. Disposed along opposed water walls 4 are windboxes 3. In a typical installation, shown in FIG. 1, an ignitor 5 is disposed intermediate a portion of the water wall 4 and the windbox 3. For convenience in describing the invention, the term "windbox" will be used to include the duct attached thereto.

The seal 10 in accordance with the preferred form of the invention will extend along the entire interface between the water wall 4 and the windbox 3. Thus in a windbox 3 having a rectangular cross-section the seal 10 will extend around the entire rectangular extent thereof.

Referring now particularly to FIG. 2 there is shown in greater detail the extremity of the windbox 3. It will be understood that the FIG. 1 and 2 views are cross section views. The description that follows will refer to the shapes of the elements thereof in that cross section. The extremity of the windbox 3 is actually an attachment to the windbox 3 which comprises an L-shaped channel 12. The L-shaped channel 12 has a foot section **12*a* which is oriented vertically in FIG. 2 and a shank portion 12*b* which is generally horizontal in FIG. 2. A second L-shaped cross-section member 14 is welded to the windbox 3. It has a body or shank 14*a* thereof disposed in generally parallel relationship to the foot 12*a* of the L-shaped channel 12. The foot of the L-shaped member 14 is a flange 14*b* that cooperates with a fabric seal 16. More particularly, a bolt 18 and nut 20 secures the fabric seal 16 to the flange 14*b***.

It will thus be seen that the windbox 3, the L-shaped channel 12 and L-shaped member 14 are unitary. In other words, the L-shaped member 14 and the L-shaped channel 12 are welded to the windbox 3.

Although, the drawing shows a cross section extending through a horizontal plane and best illustrates the interface between the vertical sides of the windbox, those skilled in the art will recognize that the seal must also extend all the way around the circumference of the windbox 3. In other words the L-shaped channel 12 as well as other portions of the seal 10 will extend along the horizontal portions of the interface of the windbox 3 with the waterwall 4.

The other major portion of the seal is secured to the water wall 4. More particularly a plate 22, that is generally planar, is welded to a plurality of individual tubes 4*a* and also welded to a second generally planar plate 24. The plate 24 is disposed in perpendicular relationship to the plate 22 and is also disposed in co-planar face to face abutting relationship to the foot 12*a* of the L-shaped channel 12.

Welded to the lower extremity (as shown in FIG. 2) of the plate 24 is a plate 26. The plate 26, in the illustrated embodiment, comprises a flange 26*a* that is generally horizontal in the FIG. 2 and bevel portion 26*b* that extends in an oblique direction. The oblique part 26*b* of the plate 26 bears against the lower rounded extremity of the foot 12*a* of the L-shaped channel 12. The specific shape of this member will necessarily vary in various installations because of the wide variety of structures that are utilized.

It will thus been seen that the L-shaped channel 12 nests in face to face planar surface abutment against the plate 24 which is welded to the water wall 4 and also abuts the plate 26. Fixed to the flange 26*a* by bolt 18 and nut 20 is the fabric seal 16. It will be understood that the plate 26 extends completely around the windbox 3 and that a plurality of such bolts 18 and nuts 20 secure the fabric 16 to the plate 26. Similarly a plurality of bolts 18 and nuts 20 secure the fabric 16 to the flange 14*b* which will also extend around the entire interface between windbox 3 and the waterwall 4.

Disposed within the chamber defined by the L-shaped channel 12, the shank or body 14*a* of the L-shaped member 14, the fabric seal 16 and the plate 26 is an insulating material 30. Preferably, the insulating material is a high density high temperature characteristic insulation. This insulation is intended to prevent hardened fly ash buildup around the joint and protect the joint from temperatures in excess of 1,000 degrees Fahrenheit. One suitable insulation is a ceramic wool, identified by the trademark CER-WOOL, and manufactured by Premier Refractories and Chemicals, Inc. having a place of business in King of Prussia, Pa. The fabric seal 16 may be a composite of fiberglass with inconel wire on the outside surface thereof. Both sides may be coated with an alkyd heat resistant coating. One such high temperature fabric expansion joint is manufactured by Raybestos Manhattan Energy Products having a place of business at Ladson, S.C.

It will be seen that in operation that the windbox 3 including the L-shaped channel 12 and L-shaped member 14 may move vertically (as shown in FIG. 2) with respect to the subassembly of the plate 24, plate 22 and water wall 4 in response to thermal expansion. It will be further seen that in the event furnace gasses pass intermediate the plate 24 and the foot 12*a* of the L-shaped channel 12 they will pass intermediate the plate 26 and the lower (as viewed) extremity of the foot 12*a* of the L-shaped channel 12. Ordinarily the insulation 30 will prevent any passage of the furnace gasses further. This will tend to protect the fabric seal 16 which is necessary to allow the relative movement of the parts fixed to the windbox/duct 3 and the parts fixed the to water wall 4.

In some embodiments of the invention a bolt 32 and nut 34 secure the foot 12*a* of the L-shaped channel 12 to the plate 24. In some cases a slot may be provided in one or both of the elements so that some relative sliding movement may occur. In other embodiments of the invention, the bolt 32 and nut 34 are omitted and replaced with a slide connection.

The invention has been described with reference to its illustrated preferred embodiment. Persons skilled in the art of such devices may upon disclosure to the teachings herein, conceive other variations. Such variations are deemed to be encompassed by the disclosure, the invention being delimited only by the following claims.

Having thus described my invention I claim:

1. A furnace apparatus which comprises:

a plurality of water walls each including a plurality of tubes, said water walls collectively enclosing a combustion chamber;

a plurality of windboxes, each of said windboxes being disposed intermediate adjacent water walls;

a seal assembly sealing the interface respective windboxes with said water walls adjacent thereto;

each of seal assemblies comprising first and second generally planar plates disposed in face to face abutting relationship;

first means for mounting said first plate to said water wall and second means for mounting said second plate to said windbox, said means for mounting said first plate and said means for mounting said second plate defining a chamber therebetween, said apparatus including means for enclosing said chamber that includes a flexible member allowing relative movement between said first and second plates; and insulation disposed within said chamber to obstruct the passage any gasses passing intermediate said first and second plates into said chamber.

2. The apparatus as described in claim 1 wherein:

said second means for mounting comprises an L-shaped channel.

3. The apparatus as described in claim 2 wherein said first means for mounting comprises:

a generally planar first plate welded to respective tubes of said water wall.

4. The apparatus as described in claim 3 wherein:

said means for enclosing includes an L-shaped member having a first flange at one axial extremity.

5. The apparatus as described in claim 4 wherein:

said means for enclosing further includes a plate having a second flange at one axial extremity, said other axial extremity being welded to said first plate.

6. The apparatus as described in claim 5 wherein:

said means for enclosing further includes a fabric portion joining said first and second flanges.

7. The apparatus as described in claim 6 wherein:

said means for enclosing has insulation disposed therein.

8. The apparatus as described in claim 7 wherein:

said insulation is ceramic wool material.

9. The apparatus as described in claim 8 wherein:

said first and second plates are joined together by a bolt and nut.

10. The apparatus as described in claim 9 wherein:

said insulation is joined to said first and second flanges by respective nuts and bolts.

* * * * *